United States Patent [19]

Brossmer

[11] Patent Number: 4,611,410

[45] Date of Patent: Sep. 16, 1986

[54] APPARATUS FOR THE HEAT TREATMENT OF SYNTHETIC YARN

[75] Inventor: Maximilian Brossmer, Hanau, Fed. Rep. of Germany

[73] Assignees: D.I.E.N.E.S. Apparatebau GmbH, Mülheim; Karl Mayer Textilmaschinenfabrik GmbH, Obertshausen, both of Fed. Rep. of Germany

[21] Appl. No.: 593,918

[22] Filed: Mar. 27, 1984

[30] Foreign Application Priority Data

Mar. 31, 1983 [DE] Fed. Rep. of Germany ..... 3311777

[51] Int. Cl.[4] ..... F26B 3/22

[52] U.S. Cl. ..... 34/41; 34/155; 28/179

[58] Field of Search ..... 34/41, 155; 432/8, 59; 28/240, 241, 179

[56] References Cited

U.S. PATENT DOCUMENTS 4,389,966 6/1983 Getz ..... 118/405

FOREIGN PATENT DOCUMENTS 883613 12/1961 United Kingdom .

*Primary Examiner*—Larry I. Schwartz

*Attorney, Agent, or Firm*—Horst M. Kasper

[57] ABSTRACT

An apparatus for the heat treatment of synthetic yarn is provided where synthetic yarn is provided by a synthetic yarn source and is fed via rollers to a first heating surface and then via a heating pin to a second heating surface and from there via rollers to a warping beam. A speed control of the yarn and a breakage control of the yarn can be provided. Depending on the resulting control signals the heating pin and concurrently therewith a cam wheel can be rotated, where the cam wheel and the heating pin are joined by an endless cable. The cam wheel is connected to the two heating surfaces via bars which allow to move and remove the heating surfaces from the path of the yarn. Heat transfer can be provided from the output rollers to the input rollers.

16 Claims, 1 Drawing Figure

APPARATUS FOR THE HEAT TREATMENT OF SYNTHETIC YARN

DESCRIPTION

BACKGROUND OF THE INVENTION

1. Field of the Invention

The present invention relates to an apparatus for the heat treatment of synthetic yarn comprising at least one curved heating surface, where the length over which the yarn engages said heating surface can be changed.

2. Brief Description of the Background of the Invention Including Prior Art

British patent specification No. 883 613 shows an apparatus of this kind where the yarn is guided twice along the heating surface such that it engages this surface over the total length of the surface during the first run, but engages only part of the surface during the second treatment. The yarn is fed with constant speed to the heater, and the length at which the yarn engages the heater surface during the second treatment can be adjusted by means of an adjustable feed roller.

A heater may be used where the yarn is guided along a slightly curved heating surface in order to supply the heat required for stretching or setting a running yarn. This heating surface may be heated electrically or by means of steam. In known heating apparatuses, the heating surface forms part of the wall of a heating vessel which is partially filled with a heat transfer liquid and partially filled with vapor of said liquid. This type of heater warrants a uniform temperature along the entire length of the heating surface. The amount of heat transferred to the yarn mainly depends on the temperature of the heating surface and on the period of time during which the yarn engages the heating surface. This period of time is determined by the length of the heating surface and by the speed of the yarn.

During the treatment of the yarn, the speed of the yarn and the temperature of the heater normally are kept constant. During the starting period of the treatment process and in the case of a yarn break, the speed of the yarn changes essentially, and therewith the period of time changes during which the yarn engages the heating surface. In order to prevent overheating of the yarn during the starting period, the temperature of the heater was raised in accordance with the increasing yarn speed, and in the case of a yarn break the supply of energy to the heater was interrupted immediately. The thermal intertia of the heater, however, does not permit a continuous alignment of the heat supply to the instant speed of the yarn without delay.

SUMMARY OF THE INVENTION

1. Purposes of the Invention

It is an object of the invention to provide a yarn-treating apparatus with improved adjustment of the heat supply to the yarn in accordance with the heat demand of the yarn when the yarn is moved with different speeds.

It is another object of the present invention to provide a yarn stretching apparatus where yarn breakage is monitored and in such case the heat supplies are removed.

It is a further object of the invention to provide a method which couples the motion of a heating pin and of the thermal surfaces for simultaneous action of the thermal transfer onto the yarn over the apparatus.

It is a further object of the invention to provide an apparatus, where the stretching and setting of the yarn and the forming of the warp beam can be achieved in a single continuous process.

These and other objects and advantages of the present invention will become evident from the description which follows.

2. Brief Description of the Invention

The present invention provides an apparatus for the heat treatment of synthetic yarns which comprises at least one curved heating surface receiving yarn from a yarn supply source and provided such that the length over which the yarn engages the heating surface can be changed, an axis disposed perpendicular to the plane of curvature of said heating surface and where the heating surface can tilt around this axis, and an actuator for tilting the heating surface depending on the speed of the yarn.

Means can be provided for controlling the actuator for tilting the heating surface dependent on the speed of a feed roller for the yarn. A yarn break detector can control the actuator for tilting the heating surface. A roller can be disposed between the yarn supply source and the heating surface for allowing redirection of the yarn. The heating surface can heat the yarn to the stretching temperature. A heating pin for determining the stretch point of the yarn coming from the heating surface. A second heating surface can be provided for heating the yarn coming from the heating pin. A second roller can redirect the yarn coming from the second heating surface. A warp beam can receive the stretched yarn.

The two heating surfaces together with the heating pin can form two sides of a triangle and are supported tiltable around the axis of the heating pin. An individual tilting actuator can be provided for each heating surface. A common tilting actuator can be provided for the two heating surfaces. A heat can be disposed at the heating pin, which heater supplies heat to only half of the circumference of the pin and the pin is tiltably supported around its axis. A vessel to be filled with saturated vapor of a heat transfer liquid can provide part of a heating surface and comprise a lower condensation portion. An electrical heater can be inserted in the lower condensation portion of the vessel.

A heater roller can be disposed in the path of the yarn before entering the first heating surface. A cooling roller can be provided in the path of the yarn after leaving the second heating surface, and preferably the heating roller and the cooling roller are hollow rollers. Heat transport piping can connect the heating roller and the cooling roller. A bar can connect an eccentric actuator to each of the two heating surfaces. A cable can connect the eccentric actuator to the heating pin. A tensioning roll can be disposed to provide tensioning to the cable.

There is also provided a method for heat treating synthetic yarn which comprises feeding yarn from a yarn supply source to a curved heating surface adjustable for the length of contact of the yarn with the heating surface, determining the speed of passage of the yarn, and tilting the heating surface dependent on the speed determination of the yarn.

A motion of the heating surface can be actuated upon a change in the speed of the yarn. A yarn break can be sensed with a yarn break detector. The yarn coming from the yarn supply source can be redirected with a first roller to the heating surface. The yarn coming from the heating surface can pass over a heater pin. The yarn coming from the heater pin can run over a second heater surface. The yarn coming from the second heater surface can be redirected via a second roller to a warp beam.

The waste heat from the second roller can be transported via heat transport piping to the first roller. The first roller can be heated with the waste heat collected by the second roller. The speed of the yarn can be sensed with a sensor. A cam wheel can be rotated depending on the speed of the yarn for adjusting the position of the heating surface. The heating pin can be moved concurrently with the cam wheel via a coupling cable between the cam wheel and the heating pin. The tension of the cable can be adjusted when required.

For achieving the invention object the heating surface is supported tiltably around an axis extending perpendicularly with respect to its plane of curvature and an operator controlled, in accordance with the speed of the yarn, is provided for turning the heating surface dependent on the yarn's speed. The operator for tilting the heating surface may be controlled in accordance with the speed of a supply roller and/or may be controlled by a yarn break detector.

For the manufacture of webs from synthetic yarn, a warp beam is made of a group of synthetic fibers. This warp beam consists of several parallel wound warp fibers and prepares them for the subsequent weaving process. Before winding the group of fibers onto the warp beam, the fibers are stretched and set. The required efforts for stretching the fibers and forming the warp beam could be reduced, if instead of two separate process portions consisting of stretching and setting on the one side and forming the warp beam on the other side, both yarn treating operations could be achieved by a continuous process.

For achieving the object of a single continuous process in accordance with the invention, a stretching apparatus is provided between a feeding gate and the warp beam, said apparatus comprising between two rollers a first heating surface for heating the fibers to the stretching temperature, further comprising a heating pin determining the stretching point of the fibers and finally comprising a second heating surface supplying the required heat for setting the fibers.

Using two heating vessels with saturated vapor for heating the heating surface is preferred in order to achieve a uniform temperature distribution along the total width of the heating surface and therewith for all of the fibers of said group of fibers forming the warp beam. The vessel may comprise water-steam, or for high treatment temperatures may comprise particular heat treatment liquids such as Dow Therm (Trademark of Dow Chemical Corp).

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

The sole FIGURE is a schematic view of an apparatus for heat treatment of synthetic yarn.

DESCRIPTION OF INVENTION AND PREFERRED EMBODIMENTS

Figure 1:
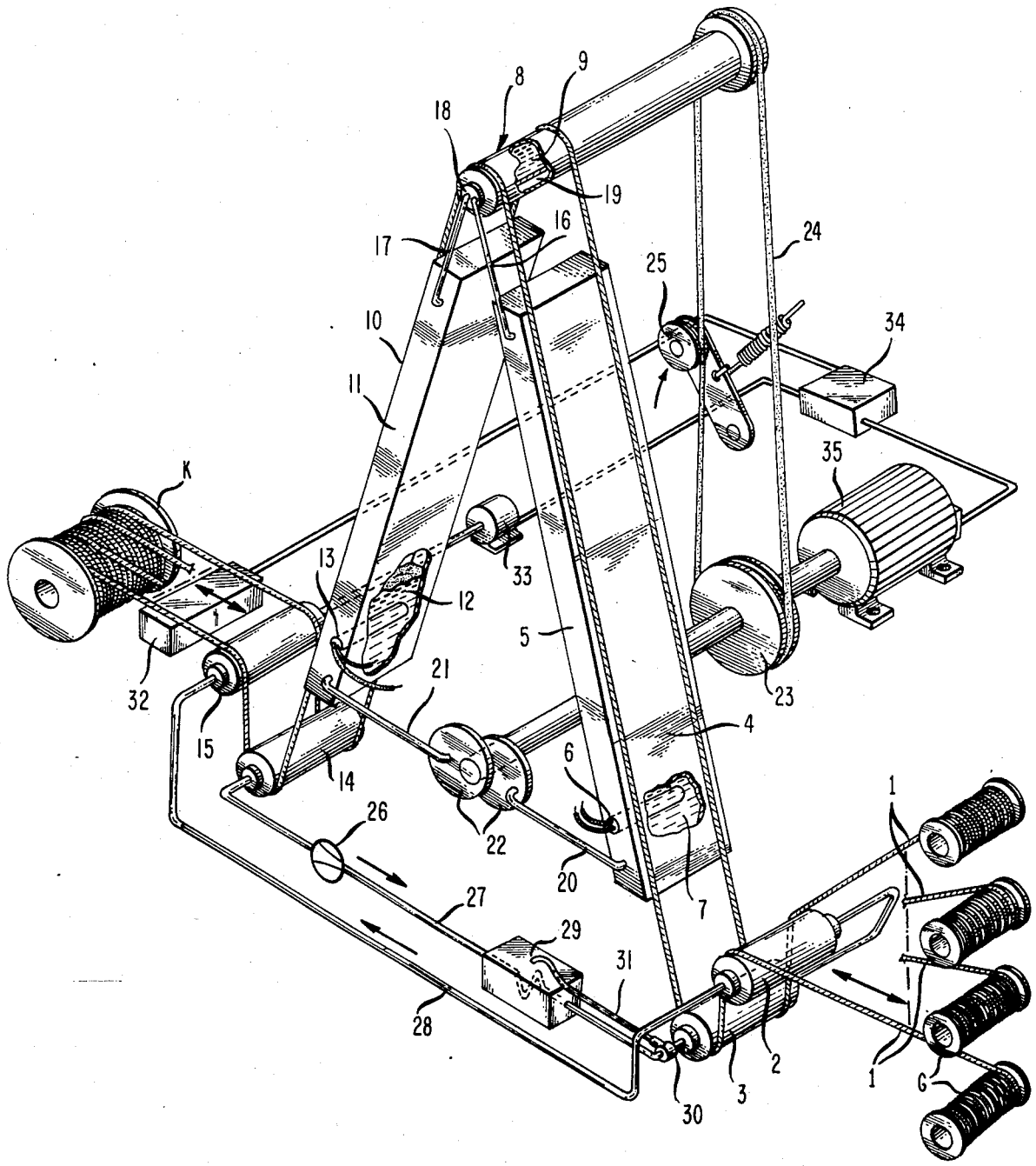

In accordance with the present invention there is provided an apparatus for the heat treatment of synthetic yarns which comprises at least one curved heating surface provided such that the length at which the yarn engages the heating path can be changed, where the heating surface is born tiltably around an axis extending perpendicular to the plane of curvature of said heating surface and where an actuator is provided for tilting the heating surface dependent on the speed of the yarn.

The actuator for tilting the heating surface can be controlled depending on the speed of a feed roller for the yarn. The actuator for tilting the heating surface can be controlled by a yarn break detector.

At least one curved heating surface can be provided, at which the yarn engages with changeable length, for stretching synthetic yarn during establishment of a warp beam where the yarn in the path to the warp beam travels between two rollers and a first heating surface for heating the yarn to the stretching temperature, a heating pin for determining the stretch point and a second heating surface for setting the yarn are provided between these two rollers.

The two heating surfaces together with the heating pin form two sides of a triangle and are born tiltable around the axis of the heating pin. Each of the heating surfaces is associated with an individual tilting actuator. A common tilting actuator is provided for both heating surfaces. The heating pin comprises a heater which supplies heating energy only to half of the circumference of the pin and whereat the pin is born turnable around its axis. The heating surface is part of a vessel filled with saturated vapor of a heat transfer liquid, and an electrical heater is inserted in the lower condensation portion of the vessel. A heated roller is provided in the path of the yarn before entering the first heating surface and a cooling roller is provided in the path of the yarn after leaving the second heating surface, where both rollers are hollow rollers and are connected to each other via a common heat transport piping.

A preferred embodiment of the invention will now be described with reference to the attached single drawing. The group 1 of fibers fed to the apparatus according to the invention from a supply gate G and consisting for instance of 200 parallel partially stretched fibers is guided through two rollers 2 and 3 to a first slightly curved heating surface 4 formed by a wall portion of vessel 5 which is partially filled with saturated vapor, in particular water-steam. The supply of heat to this stretching heater is achieved by means of resistance heaters 6 which are immersed into the lower portion 7 of the heating vessel 5 which is filled with the steam condensate. During engagement with heating surface 4, the group of fibers is heated to a stretching temperature between 70 degrees centigrade and 100 degrees centigrade. From this heating surface 4, the group of fibers moves to stretching pin 8 which, as indicated in the drawing, is heated only about 180 degrees of its circumference. For this purpose, only one half 9 of the stretching pin is filled with saturated steam which is heated in a similar manner as the steam within vessel 5. Heating pin 8 determines the stretching point for the final stretching of the group of fibers 1.

From the stretching pin 8, the group of fibers 1 moves to a second heating surface 10 forming part of a vessel 11. This heater serves for setting the yarn. This heater, similar to heating vessel 5, is a saturated vapor heater and provides the required temperature of for instance 150 degrees centigrade to 240 degrees centrigrade which is necessary for setting the yarn. Instead of water-steam, in this case a specific heat transmission liquid having a higher boiling temperature is used and is heated by means of a heater 13 immersed into the lower portion 12 of vessel 11. From this set heater 11 the group of fibers 1 is by means of two rollers 14 and 15 moved to the warp beam K. In the shown position of heaters 5, 8 and 11 the group of fibers 1 engages each heater along its total heated length. In case of a yarn break, the yarn speed suddenly is reduced to zero and the supply of heat to the yarn must be interrupted as soon as possible. For this purpose the stretching heater 5 is by means of a bar 16 tiltable around an axis 8 which extends perpendicular with respect to the plane of the drawing. Similarly setting, heater 11 is fixed tiltable around the same axis by means of arm 17. Stretching pin 18 is also tiltable around axis 8 with the lower portion 19 of pin 8 being not heated. The other ends of vessels 5 and 11 are connected by means of bars 20 and 21 to a common eccentric actuator 22. A pulley 23 together with a cable 24 provide a moving connection between the eccentric actuator 22 and the stretching pin 8, whereat a roll 25 keeps cable 24 under tension. In case of a yarn break, a yarn break detector 32 initiates turning of the eccentric actuator 22 around a predetermined angle. In the course of this turning of the actuator 22, the two heating vessels 5 and 11 are tilted by means of bars 20 and 21 around axis 18 in such a way that the angle between them becomes smaller and the heating surfaces 4 and 10 do no longer engage the group of fibers which are guided between roller 3, pin 8 and roller 14. Furthermore, stretching pin 8 is turned by 180 degrees around its axis 18 such that now its non-heated zone 19 engages the fibers, and therewith no further heating energy is supplied to the fibers by pin 8. Instead of a common tilting actuator which in the present case is an eccentric actuator, individual actuators for the two heating surfaces and the stretching pin may be provided such as hydraulic operators, electrical motors or spring-operated actuators.

When the warp beam is accelerated and the speed of the yarn increases, a constant period of time during which the yarn engages the heating surfaces 4 and 10 and the heated portion of pin 8 is achieved in this way that the heating surfaces 4 and 10 at the beginning only engage with a short portion of yarn 1. With an increasing speed of the yarn, the length of engagement of the heating surfaces 4 and 10 and of the heated portion 9 of stretching pin 8 as far as it engages yarn 1, is increased until these heating elements engage the yarn along their full length. For this purpose the yarn speed for instance is measured via the speed of the feeding roller by tachometer 33 and controls via a controller 34 and motor 35 the tilting actuator for both heating vessels 5 and 11, and for the stretching pin in such a way dependent on the yarn's speed that the time of engagement of the yarn on the associated heating surface remains the same. This is provided under the assumption that the temperature of the heating surfaces 4 and 10 and of the heated portion 9 of stretch pin 8 remains unchanged.

In the shown embodiment, the two heating surfaces 4 and 10 together with stretch pin 8 form two sides of a triangle. The invention, however, is not limited to this particular structure and arrangement of the individual heating elements. It may be used also in connection with a different arrangement of the yarn supply means for the warp beam. Dependent on the arrangement of the individual heating elements either a common actuator or separate actuators for moving the heating elements might be provided.

The yarn leaving heating surface 10 can only be winded onto the warp beam if the yarn was cooled sufficiently. This cooling partially is achieved on rollers 14 and 15 and partially by means of the air through which the yarn moves when travelling from roller 15 to the warp beam K. Rollers 14 and 15 therefore are heated by the yarn. This heat may be used as a heat source for heating feed rollers 2 and 3. For this purpose rollers 2, 3, 14 and 15 are hollow and their internal space is connected together via pipes 27 and 28. A heat transporting medium such as water is pumped between these rollers, and the direction of flow is chosen such that the heating medium from roller 15 flows through roller 14 and then through a heating/cooling apparatus 29 to rollers 3 and 4 and back from there to roller 15. In this manner, rollers 2 and 3 are heated and deliver their heat to the yarn 1 entering roller 2. The liquid is cooled, and by flowing to rollers 15 and 14 provides a cooling action for these rollers and the yarn travelling around them.

In order to keep a constant roller temperature at rollers 3 and 4, which does not depend on the speed of the yarn, the thickness of the yarn and the temperature of heating surfaces 4 and 10, the temperature of the heat transport medium at the inlet of roller 3 is measured by means of a temperature sensor 31. The output signal of this temperature sensor controls the heating/cooling apparatus 29 in such a way that the temperature of the heat transport liquid at position 30 is kept constant.

It will be understood that each of the elements described above, or two or more together, may also find a useful application in other types of stretching system configurations and yarn processing procedures differing from the types described above.

While the invention has been illustrated and described as embodied in the context of an apparatus for heat treatment of synthetic yarn, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for the heat treatment of synthetic yarns comprising a yarn supply source;

at least one curved heating surface receiving yarn from the yarn supply source and provided such that the length over which the yarn engages the heating surface can be changed;

an axis disposed in parallel to a tangental plane of the surface of said heating surface and where the heating surface can tilt around this axis for varying the length of contact between heating surface and yarn such that in case of a larger speed a longer length of contact can be provided; and an actuator for tilting the heating surface depending on the speed of the yarn.

2. The apparatus according to claim 1 further comprising a feed roller for the yarn;

means for controlling the actuator for tilting the heating surface dependent on the speed of a feed roller for the yarn.

3. The apparatus according to claim 1 further comprising a yarn break detector controlling the actuator for tilting the heating surface.

4. The apparatus according to claim 1 further comprising a roller disposed between the yarn supply source and the heating surface for allowing redirection of the yarn;

wherein the heating surface heats the yarn to the stretching temperature;

a heating pin for determining the stretch point of the yarn coming from the heating surface;

a second heating surface for setting the yarn coming from the heating pin;

a second roller for redirecting the yarn coming from the second heating surface; and a warp beam for receiving the stretched yarn.

5. The apparatus according to claim 4 wherein the two heating surfaces together with the heating pin form two sides of a triangle and are supported tiltable around the axis of the heating pin, which axis coincides with said axis disposed in parallel to a tangential heating surface.

6. The apparatus according to claim 4 further comprising an individual tilting actuator for each heating surface.

7. The apparatus according to claim 4 further comprising a common tilting actuator for the two heating surfaces.

8. The apparatus according to claim 4 further comprising a heater disposed at the heating pin which supplies heat to only half of the circumference of the pin and wherein the pin is tiltably supported around its axis.

9. The apparatus according to claim 4 wherein saturated vapor of a heat transfer liquid is coming from a vessel filled with vapor and the vessel providing part of a heating surface and comprising a lower condensation portion; and wherein heat energy is furnished by an electrical heater inserted in the lower condensation portion of the vessel.

10. The apparatus according to claim 4 further comprising a heated roller disposed in the path of the yarn before contacting the first heating surface;

a cooling roller provided in the path of the yarn after leaving the second heating surface, wherein the heating roller and the cooling roller are hollow rollers; and heat transport piping connecting the heating roller and the cooling roller.

11. The apparatus according to claim 4 further comprising an eccentric actuator;

a bar connecting the eccentric actuator to each of the two heating surfaces;

a cable connecting the eccentric actuator to the heating pin; and a tensioning roll disposed to provide tensioning to the cable.

12. A method for heat treating synthetic yarn comprising feeding yarn from a yarn supply source to a curved heating surface for moving across said heating surface, which is adjustable for the length of contact of the yarn with the heating surface by tilting the heating surface;

determining the speed of passage of the yarn; and tilting the heating surface dependent on the speed of the yarn for changing the length of contact between the yarn and the heating surface such that in case of a larger speed a longer length of contact is provided.

13. A method for heat treating synthetic yarn according to claim 12 further comprising actuating a motion of the heating surface upon a change in the speed of the yarn.

14. A method for heat treating synthetic yarn according to claim 12 further comprising sensing a yarn break with a yarn break detector.

15. A method for heat treating synthetic yarn according to claim 12 further comprising redirecting the yarn coming from the yarn supply source with a first roller to the heating surface;

passing the yarn coming from the heating surface over a heater pin;

running the yarn coming from the heater pin over a second heater surface; and redirecting the yarn coming from the second heater surface via a second roller to a warp beam.

16. A method for heat treating synthetic yarn according to claim 15 further comprising transporting the waste heat from the second roller via heat transport piping to the first roller; and heating the first roller with the waste heat collected by the second roller.

* * * * *